US010695266B2

(12) United States Patent
Zhang

(10) Patent No.: US 10,695,266 B2
(45) Date of Patent: Jun. 30, 2020

(54) EFFICIENT SPONTANEOUS ELECTROCHEMICAL CURRENT INTERACTING PRESS NEEDLE

(71) Applicant: HANGZHOU YUANLI MEDICAL INSTRUMENT Co., Ltd, Zhejiang (CN)

(72) Inventor: Chaolun Zhang, Zhejiang (CN)

(73) Assignee: HANGZHOU YUANLI MEDICAL INSTRUMENT Co., Ltd, Zhejiang (CN)

( * ) Notice: Subject to any disclaimer, the term of this patent is extended or adjusted under 35 U.S.C. 154(b) by 182 days.

(21) Appl. No.: 15/554,432

(22) PCT Filed: Jun. 29, 2016

(86) PCT No.: PCT/CN2016/087659
§ 371 (c)(1),
(2) Date: Aug. 30, 2017

(87) PCT Pub. No.: WO2017/028629
PCT Pub. Date: Feb. 23, 2017

(65) Prior Publication Data

US 2018/0049944 A1 Feb. 22, 2018

(30) Foreign Application Priority Data

Aug. 17, 2015 (CN) ..... 2015 1 0514089
Aug. 17, 2015 (CN) ..... 2015 2 0631644 U

(51) Int. Cl.
*A61H 39/08* (2006.01)
*A61H 39/04* (2006.01)
(Continued)

(52) U.S. Cl.
CPC ..... *A61H 39/086* (2013.01); *A61H 39/04* (2013.01); *A61H 39/08* (2013.01); *A61H 39/06* (2013.01);
(Continued)

(58) Field of Classification Search
CPC ..... A61H 39/00; A61H 39/002; A61H 39/02; A61H 39/04; A61H 39/06; A61H 39/08;
(Continued)

(56) References Cited

U.S. PATENT DOCUMENTS

2004/0044390 A1* 3/2004 Szeles ..... A61H 39/002 607/142
2006/0079946 A1* 4/2006 Gavronsky ..... A61N 1/36021 607/46
2006/0085056 A1* 4/2006 Schouenborg ..... A61N 1/0456 607/148

FOREIGN PATENT DOCUMENTS

CN 202950933 U * 5/2013

OTHER PUBLICATIONS

English Translation of Written Opinion of International Searching Authority dated Sep. 14, 2016 for PCT Appln. No. PCT/CN2016/087659, filed Feb. 17, 2018.*
(Continued)

*Primary Examiner* — Diane D Yabut
(74) *Attorney, Agent, or Firm* — JCIPRNET

(57) ABSTRACT

An efficient spontaneous electrochemical current interacting press needle that relates to an acupuncture press needle of traditional Chinese medicine is provided. The efficient spontaneous electrochemical current interacting press needle includes a press needle and a conductive medical tape that fixes the press needle and attaches other press needles. The conductive medical tape includes a conductive adhesive and a gummed cloth. The press needle is adapted to be fixed on the conductive medical tape that fixes the press needle and
(Continued)

attaches other press needles. In addition, a connecting conductive medical tape and/or an external conductor connecting point that is capable of attaching two or more press needles is also provided.

4 Claims, 3 Drawing Sheets

(51) Int. Cl.
*A61H 39/00* (2006.01)
*A61H 39/06* (2006.01)

(52) U.S. Cl.
CPC ..... *A61H 39/083* (2013.01); *A61H 2039/005* (2013.01)

(58) Field of Classification Search
CPC ..... A61H 39/083; A61H 2039/005; A61N 1/0502; A61N 1/36021; A61N 1/36071
See application file for complete search history.

(56) References Cited

OTHER PUBLICATIONS

English Machine Translation of Description of CN 202950933 U (Zhang et al.) from Patentscope website<hhtps:patentscope.wipo.int=""></hhtps:><https: patentscope.wipoint="">, accessed May 27, 2019 </https:>.*

* cited by examiner

EFFICIENT SPONTANEOUS ELECTROCHEMICAL CURRENT INTERACTING PRESS NEEDLE

CROSS-REFERENCE TO RELATED APPLICATION

This application is a 371 application of the International PCT application serial no. PCT/CN2016/087659, filed on Jun. 29, 2016, which claims the priority benefit of China application no. 2015206316644.0, filed on Aug. 17, 2015 and the priority benefit of China application no. 201510514089.8, filed on Aug. 17, 2015. The entirety of each of the abovementioned patent applications is hereby incorporated by reference herein and made a part of this specification.

TECHNICAL FIELD

This invention relates to the press needle as a device for acupuncture and moxibustion of traditional Chinese medicine.

BACKGROUND ART

The traditional press needle in the prior art is in a (small) pushpin style wound by metal wire (generally, stainless steel wire), with its acupuncture and acupoint effect (Patent No. 200610048914.0 A Multi-head Surface Characteristic Difference Device for Filiform Needle and Intradermal Needle in Electrochemical Acupuncture), it is applied to acupoint treatment in fields of acupuncture and moxibustion of traditional Chinese medicine etc. Due to small press needle, its direct electrochemical effect and scope are limited to small electrochemical effect scope of one such press needle only. Although the electrochemical effect scope of such press needle has been expanded by means of sticking plaster and medical magnet that fix the press needle (Patent No. 201220273035.9 A Press Needle Electrochemical Sticking Plaster), such technology achieves direct electrochemical effect and scope limited to small local area of such press needle and sticking plaster only, in addition, due to limited and unstable conductivity of such sticking plaster, higher, stronger and better synergic electrochemical effect of the press needle and sticking plaster in such small local area cannot be achieved. It's obvious that although such prior arts have direct electrochemical effect to local acupoint tissue, they cannot achieve direct effect to tissues of channels and collaterals etc. or even to the whole organism of larger scope. Even multiple electrochemical press needles and/or electrochemical sticking plasters are adopted (for the larger scope required), due to lack of conditions required for direct electrochemical effect, synergic interaction cannot be realized to directly achieve higher, stronger and better spontaneous electrochemical current interacting effect to acupoint channels and collaterals in larger area and scope among the multiple press needles. Therefore, it can be seen that creative labor is still required to research and develop an electrochemical press needle product solution that can realize complementary efficient direct interaction of multiple press needles and efficiently achieve higher, stronger and better spontaneous electrochemical current and interaction in large area and scope to directly dredge the channels and collaterals and regulate & stimulate overall qi function.

In addition, due to the limitation of the traditional cognitive bias of "apply local acupoint stimulation (through direct electrochemical effect) to affect and regulate relevant channels & collaterals and internal organs for treatment", the innovative solution of overall electrochemical acupuncture effect of multiple acupoints and multiple embedded press needles with efficient interaction is still limited by the said traditional cognitive bias. Besides, the tape of the traditional fixed press needle is also limited by the said traditional cognitive bias with non-conductive medical tape adopted, whereas the conductive tape is only applied to various electronic products and electric appliances such as computer, mobile, electric wire and cables for shielding and isolating interference of electromagnetic wave or radio wave since it is developed, therefore, it can be seen that to overcome such problems and defects, creative labour that overcomes technology bias is still required.

CONTENT OF THE INVENTION

Purpose of the invention: to overcome the above mentioned technical problems and the defects of the above mentioned technical bias, and create a method that not only a single press needle used in small area scope can produce direct electrochemical effect higher than that of traditional press needle fixed with traditional medical tape, but also multiple press needles used in large area and scope can connect to their respective electrochemical effect fields, realizing efficient direct interactive and supplementary electrochemical effect of multiple press needles in large area and scope, achieving electrochemical effect of dredging channels & collaterals, activating blood circulation & removing stasis and regulating overall yin-yang balance much higher than that of simple adding up of the local electrochemical effects of respectively implementing multiple press needles. In addition, this invention also provides more convenient conductive connection solution for clinical electroacupuncture treatment during press needle embedding, providing safe and convenient solution for the popularization of acusector use in households.

The technical solution adopted by this invention for realizing its purpose: an efficient spontaneous electrochemical current interacting press needle, comprising the press needle and conductive medical tape that fixes the press needle and attaches other press needles, the said conductive medical tape comprises conductive adhesive and gummed cloth, the press needle is fixed on the conductive medical tape that fixes the press needle and attaches other press needles. In addition, this technical solution can be further provided with connecting conductive medical tape and/or external conductor connecting point that can attach two or more press needles.

The press needle in the above mentioned technical solution can adopt press needle that has one or more needle heads that contains different elements (such as calcium, magnesium, sodium, potassium, copper, cobalt, chromium, fluorine, iron, iodine, manganese, molybdenum, nickel, selenium, silicon, tin, vanadium, zinc and so on) for application for combined electrochemical effects that facilitate different organism needs.

In the above mentioned technical solution, the connecting conductive medical tape that fixes the press needle and attach other press needles is made of material that is conductive and harmless to human body, the gummed cloth of the connecting conductive medical tape that fixes the press needle and attaches other press needles can be made of conductive gummed cloth (facilitating the conductive adhering between the gummed cloth and other efficient spontaneous electrochemical current interacting press needles, hence facilitating the implementation of this invention), non-conductive or isolative gummed cloth (providing shielding favorable to the treatment of the implemented electrochemical treatment area). In addition, external conductor connecting point or conductive adhering connecting face can also be provided on the connecting conductive medical tape that fixes the press needle and attaches other press needles for connecting other efficient spontaneous electrochemical current interacting press needles or connecting the power lines of other treatment device used in combination with it.

The connecting conductive medical tape in the above mentioned technical solution can also adopt a conductive material that is harmless to human body, conductive connecting point or conductive connecting face can also be provided on the connecting conductive medical tape for connecting other distant efficient spontaneous electrochemical current interacting press needles or connecting the power lines of other treatment devices. The side of the connecting conductive medical tape that is not in contact with human body can also be provided with optional insulation layer for shielding favorable to the treatment in the implemented electrochemical treatment area. In the above mentioned technical solution, one or more external conductor connecting points can also be provided, and conventional conductive connection technical solution can be adopted.

This invention has the following advantages:

1. This invention has the advantage of efficient spontaneous electrochemical current direct interaction of multiple press needles: due to that uneven electron density distribution on the surface of the press needle with one or more needle heads, plus relevant electrochemical effect produced on the skin by the needle handle and the conductive medical tape, direct electrochemical effect is generated in the relevant scope of the organism as a result (attributable to the adoption of conductive medical tape, its direct electrochemical effect is more stable, stronger and more efficient than that of the "2. Sticking plaster and/or magnet" of Patent No. 201220273035.9. A Press Needle Electrochemical Sticking Plaster). More importantly, this invention can continuously connect a plurality of the aforementioned independent direct electrochemical effect areas of (each press needle) into a large area direct electrochemical effect area formed by the efficient spontaneous electrochemical current interaction of multiple press needles in the whole treatment area (e.g., large area strip or patch of direct electrochemical effect required by the disease treatment can be formed for large scope interaction, or when one or more pieces of channels & collaterals and internal organs require direct electrochemical effect to dredge, regulate and improve positive qi, the technical solution of this invention can be adopted). The technical solution of this invention can make a plurality of press needle treatment areas generate electrochemical effect area of efficient spontaneous electrochemical current interaction.

2. The electrochemical effect of this invention to dredge the channels & collaterals, activate blood circulation & removes stasis and regulate overall yin-yang balance is much greater than the simple adding up of the local electrochemical effects by respectively implementing multiple press needles: although the electrochemical effect of the press needles that enter the organism can improve the local capillary permeability & blood circulation amount of the acupoint area and the activity of the tissues and internal environment at the acupoint area of the organism, its effect area is limited to a certain scope after all. When a plurality of press needles effect the same organism, due to the limited effect area of each respective needle and the non-continuity & non-synergy among the mutual effects (e.g., the capillary permeability, blood circulation amount, and the activity performance of the organism acupoint area tissue & internal environment within the respective effective areas of the two press needles have improved, whereas those of the non-effective area between the two press needles not only are not improved, instead, due to workload undertaken or increased heavier than before, the capillary permeability, blood circulation amount, and the activity performance of the organism acupoint area tissue & internal environment within the non-effective area between the two press needles can be reduced), it's unfavorable to the treatment, or unhealthy conditions such as blockage and spasm can happen. Whereas this invention has the electrochemical effect of efficient spontaneous electrochemical current direct interaction of multiple press needles, on one hand, the capillary permeability, blood circulation amount, and the activity performance of the organism acupoint area tissue & internal environment within the respective effective areas of the applied press needles can be improved, on the other hand, electrochemical effect can also be simultaneously generated in the areas among the press needles, allowing the capillary permeability, blood circulation amount, and the activity performance of the organism acupoint area tissue & internal environment within the such areas to be also improved, facilitating local or overall treatment, greatly improving efficacy.

3. This invention can also provide convenient conduction connection for treatment such as electroacupuncture during needle embedding: according to the pharmaceuticals industry standard of the People's Republic of China YY0105-1993 Press Needle, one of the subcategories of the press needle product category is acusector press needle, however, such acusector press needle is much longer (generally 15~30 mm) with irregular projection, therefore, it cannot be used for long time embedding, and when being used for short time electroacupuncture treatment, it is not as convenient as filiform needle, therefore, even today, there's no sale and application of acusector press needle. In addition, due to that the needle section of normal press needle for embedding that enters the human body is short (2 mm at most), after the needle is penetrated and is connected to the electrode, the needle cannot be fixed for treatment (the 2 mm long needle can be easily pulled out by the electrode). Whereas the efficient spontaneous electrochemical current interacting press needle of this invention can be fixed at the treatment area by the connecting conductive medical tape, and the connecting conductive medical tape that fixes the press needle and attaches other press needles is further provided with conductive connecting face or external conductor connecting point for connecting the power lines of other treatment devices, therefore, this invention can also provide more convenient conductive connection for treatment and household popularization of medical health care apparatus such as acusector during needle embedding.

SPECIFIC IMPLEMENTATION

Figure 1:
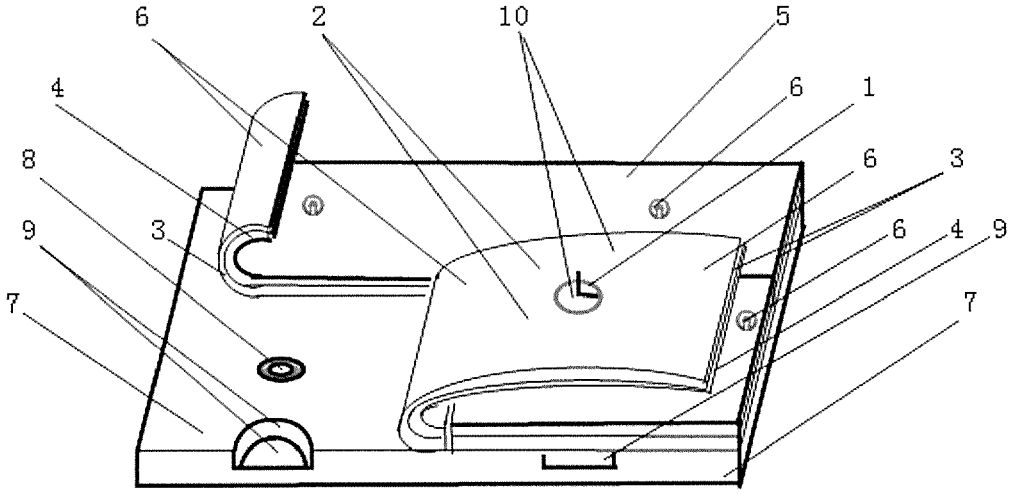
FIG. 1 is a schematic structural diagram illustrating an efficient spontaneous electrochemical current interacting press needle (where a press needle 1, a conductive medical tape 2 that fixes the press needle and attaches other press needles, a conductive adhesive 3, a gummed cloth 4, a connecting conductive medical tape 5, a conductive attaching connecting face or an external conductor connecting point 6, a positioning template 7, a positioning template corresponding needle hole 8, a notch 9 for easy peeling off from the tape, and a conductive medical tape 10 (with press needle fixed already) that fixes the press needle and attaches other press needles are shown in the figure).
Figure 2:
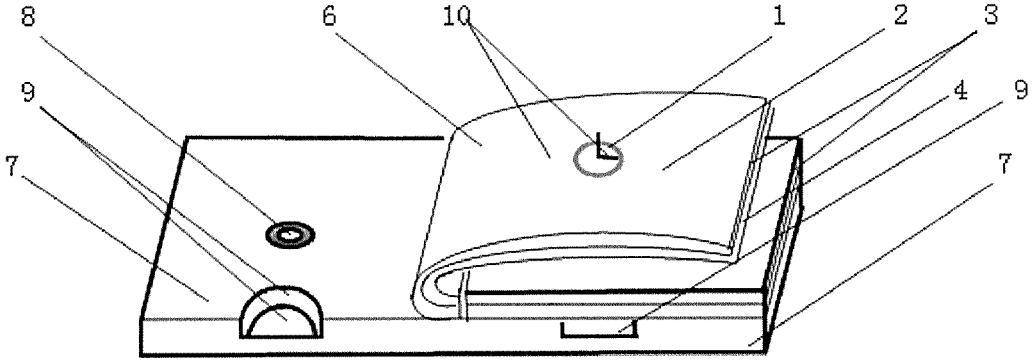
FIG. 2 is a schematic structural diagram illustrating an efficient spontaneous electrochemical current interacting press needle (multiple needles).
Figure 3:
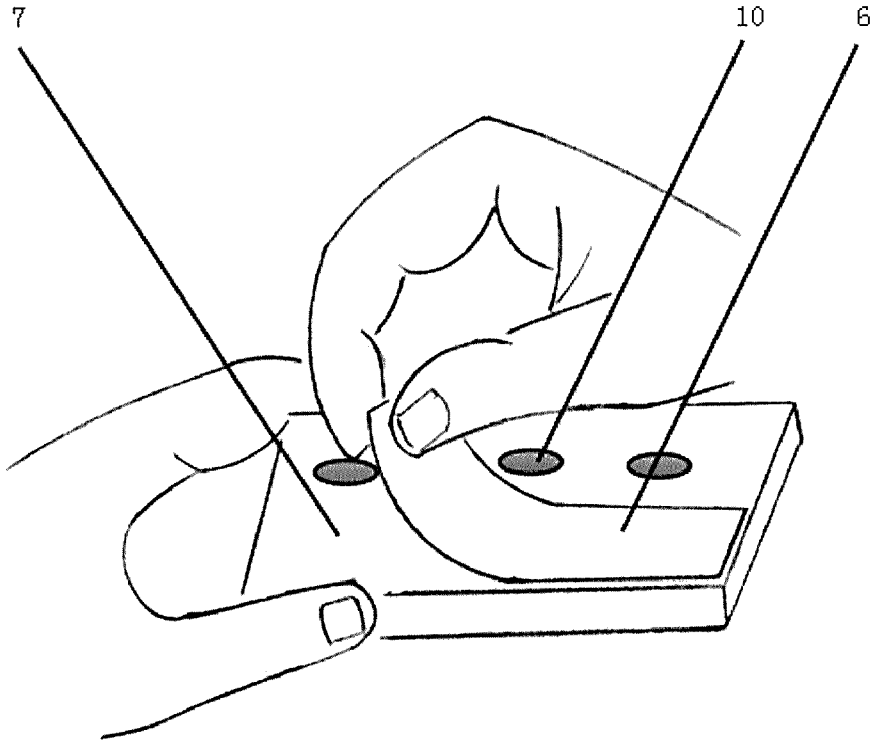
FIG. 3 is a schematic diagram illustrating a connecting conductive medical tape being peeled off from a positioning template.

FIG. 1 is a schematic structural diagram of an efficient spontaneous electrochemical current interacting press needle of this invention, which includes a press needles 1, a conductive medical tape 2 that fixes the press needle and attaches other press needles, a conductive adhesive 3, a gummed cloth 4, a connecting conductive medical tape 5, a conductive attaching connecting face or an external conductor connecting point 6, a positioning template 7, a positioning template corresponding needle hole 8, a notch 9 for easy peeling off from the tape, and a conductive medical tape (with press needle fixed already) that fixes the press needle and attaches other press needles. In specific implementation, a conductive medical tape 2 with fixed press needles 1 already that fixes the press needle and attaches other press needles can be arranged on positioning template 7 (the body of press needle 1 corresponds to the corresponding needle hole 8 on the positioning template, the adhesive side of conductive medical tape 2 that fixes the press needle and attaches other press needles is attached to positioning template 7), (an adhesive side of) the connecting conductive medical tape 5 is also attached and arranged on positioning template 7, then the whole kit is packed in sealed packing bag and sterilized for use.

Figure 4:
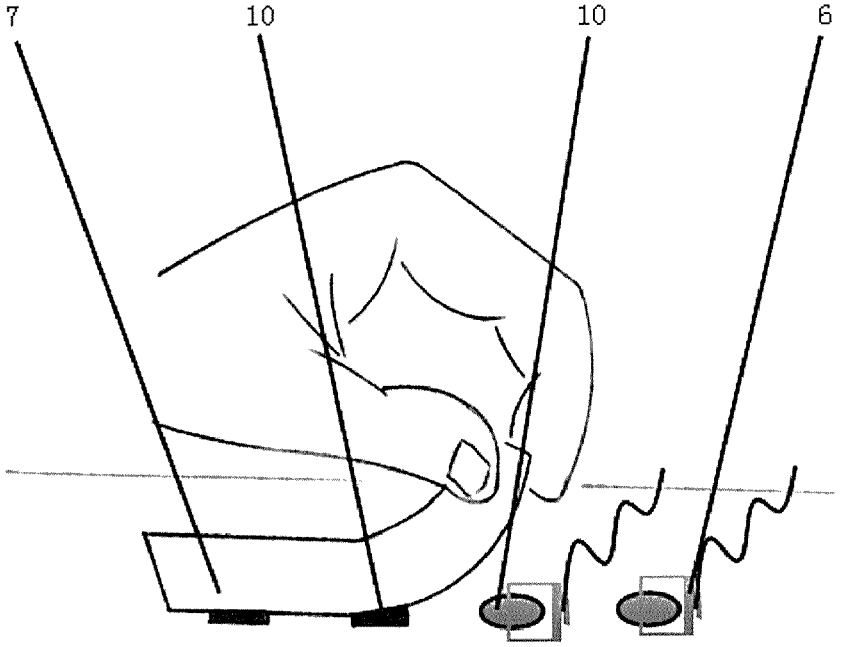
FIG. 4 is a schematic diagram illustrating a connecting conductive medical tape being used to cover and attach a plurality of embedded press needles and the channels & collaterals to generate efficient spontaneous electrochemical current that activates the channels & collaterals (also can provide more convenient conductive connection for clinical electroacupuncture treatment during press needle embedding).
Figure 5:
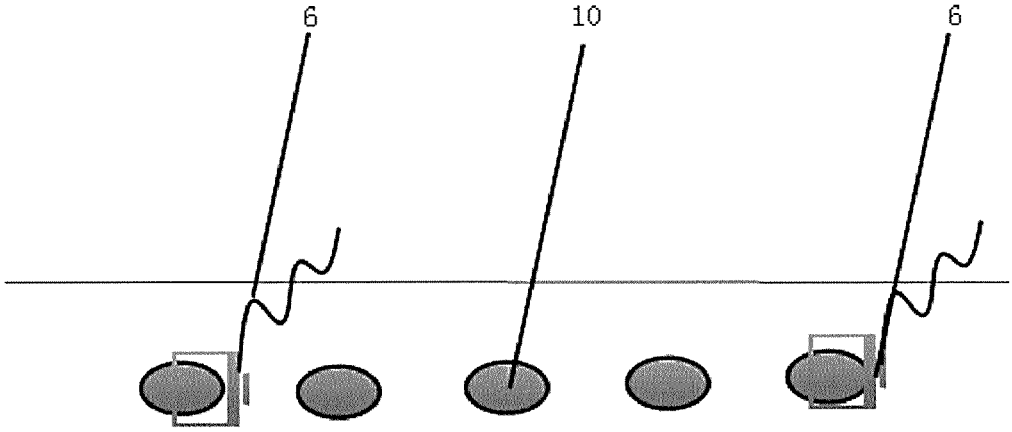
FIG. 5 is a schematic diagram illustrating an operating method of embedded needle+acusector (by using an electrode of an acusector therapeutic apparatus to cover and attach a plurality of embedded press needles)

When using, open the sealed packing bag (box), peel off the first conductive medical tape 2 fixed with press needle 1 that fixes the press needle and attaches other press needles from the notch 9 for easy peeling off the tape on positioning template 7, attach it to the target treatment acupoint, apply a little force to press. For treatment of two or more neighboring acupoints, when attaching the second conductive medical tape 2 fixed with press needle 1 that fixes the press needle and attaches other press needles, attach the conductive attaching face 6 of the conductive medical tape 2 that fixes the press needle and attaches other press needles to the gummed cloth 4 of the first conductive medical tape 2 attached already that fixes the press needle and attaches other press needles (the gummed cloth 4 of the conductive medical tape 2 that fixes the press needle and attaches other press needles adopts conductive gummed cloth). For treatment of neighboring acupoints using a plurality of conductive medical tapes 2 fixed with press needles that fix the press needles 1 and attach other press needles, just repeat the aforementioned steps to arrange sequentially is ok. For treatment of two or more acupoints far away from each other (i.e., two or more conductive medical tapes 2 fixed with press needles 1 that fix the press needles and attach other press needles cannot be mutually attached due to distance, refer to FIG. 4), just use connecting conductive medical tape 5 to cover and attach the conductive medical tapes 2 fixed with press needles already that fix the press needles and attach other press needles is ok (the gummed cloth 4 of the conductive medical tape 2 that fixes the press needle and attach other press needles should have adopted conductive gummed cloth). In addition, for conductive medical tape 2 that has non-conductive or insulating gummed cloth that fixes the press needle and attach other press needles, external conductor connecting point 6 can be provided for efficient spontaneous electrochemical current interacting treatment of two or more acupoints far from each other (i.e., two or more conductive medical tapes 2 fixed with press needles 1 that fix the press needles and attach other press needles cannot be mutually attached due to distance). Furthermore, connecting conductive medical tape 5 (or external conductor connecting point 6) can be used to attach the electrode of the required medical health care apparatus such as acusector to the conductive medical tape 2 fixed with press needle 1 that adopts conductive gummed cloth and fixes the press needle and attaches other press needles (or attach the external conductor connecting point 6) for treatment (refer to FIG. 5).

What is claimed is:

1. An efficient spontaneous electrochemical current interacting press needle, comprising:

a press needle;

a conductive medical tape with the press needle and other press needles already fixed thereon, wherein the conductive medical tape comprises a conductive adhesive and a gummed cloth, the conductive adhesive covers entirely on a surface of the gummed cloth to form a conductive attaching connecting face for directly adhering onto a human skin, and the conductive medical tape with the press needles already fixed thereon is bendable before and after adhering onto the human skin; and a connecting conductive medical tape and/or an external conductor connecting point that is capable of attaching with two or more press needles, wherein the connecting conductive medical tape and/or the external conductor connecting point is adapted to be directly attached onto a face of the conductive medical tape opposite to the conductive attaching connecting face.

2. The efficient spontaneous electrochemical current interacting press needle according to claim 1, wherein the conductive adhesive of the conductive medical tape is made of a conductive material that is harmless to a human body.

3. The efficient spontaneous electrochemical current interacting press needle according to claim 1, wherein the gummed cloth of the conductive medical tape is conductive, non-conductive or insulative.

4. The efficient spontaneous electrochemical current interacting press needle according to claim 2, wherein the press needle has one or more needle heads.

* * * * *